US005813142A

United States Patent [19]

Demon

[11] Patent Number: 5,813,142

[45] Date of Patent: Sep. 29, 1998

[54] SHOE SOLE WITH AN ADJUSTABLE SUPPORT PATTERN

[76] Inventor: Ronald S. Demon, 450 Memorial Dr., Cambridge, Mass. 02139

[21] Appl. No.: 972,450

[22] Filed: Nov. 18, 1997

Related U.S. Application Data

[63] Continuation of Ser. No. 599,584, Feb. 9, 1996, abandoned.

[51] Int. Cl.[6] ..... A43B 13/20

[52] U.S. Cl. ..... 36/29; 36/28; 73/172; 600/592

[58] Field of Search ..... 36/28, 29, 93, 36/132, 136; 73/172; 600/592

[56] References Cited

U.S. PATENT DOCUMENTS

| | | | |
|---|---|---|---|
| 3,717,039 | 2/1973 | Zinker | 73/398 |
| 4,121,453 | 10/1978 | Levin et al. | 73/172 |
| 4,267,728 | 5/1981 | Manley et al. | 73/172 |
| 4,446,634 | 5/1984 | Johnson et al. | 36/28 |
| 4,583,305 | 4/1986 | Miyamoto | 36/93 |
| 4,745,930 | 5/1988 | Confer | 128/779 |
| 4,814,661 | 3/1989 | Ratzlaff et al. | 310/328 |
| 4,827,763 | 5/1989 | Bourland et al. | 73/172 |
| 4,862,743 | 9/1989 | Seitz | 73/172 |
| 4,876,758 | 10/1989 | Rolloff et al. | 12/142 N |
| 4,995,173 | 2/1991 | Spier | 36/29 |
| 5,033,291 | 7/1991 | Podoloff et al. | 73/172 |
| 5,079,949 | 1/1992 | Tamori | 73/172 |
| 5,083,466 | 1/1992 | Holm-Kennedy et al. | 73/862.04 |
| 5,095,762 | 3/1992 | Holm-Kennedy et al. | 73/862.04 |
| 5,107,854 | 4/1992 | Knotts et al. | 128/779 |
| 5,179,792 | 1/1993 | Brantingham | 36/29 |
| 5,186,062 | 2/1993 | Roost | 73/865.4 |
| 5,199,191 | 4/1993 | Moumdjian | 36/28 |
| 5,230,249 | 7/1993 | Sasaki et al. | 36/132 |
| 5,253,435 | 10/1993 | Auger et al. | 36/29 |
| 5,253,656 | 10/1993 | Rincoe et al. | 128/782 |
| 5,257,470 | 11/1993 | Auger et al. | 36/29 |
| 5,311,779 | 5/1994 | Teruo | 73/726 |
| 5,323,650 | 6/1994 | Fullen et al. | 73/172 |
| 5,353,525 | 10/1994 | Grim | 36/88 |
| 5,357,696 | 10/1994 | Gray et al. | 36/136 |
| 5,360,016 | 11/1994 | Kovacevic | 128/782 |
| 5,361,778 | 11/1994 | Seitz | 128/779 |
| 5,363,570 | 11/1994 | Allen et al. | 36/28 |
| 5,372,487 | 12/1994 | Pekar | 36/93 |
| 5,383,290 | 1/1995 | Grim | 36/93 |
| 5,408,873 | 4/1995 | Schmidt et al. | 73/862.625 |

*Primary Examiner*—Paul T. Sewell
*Assistant Examiner*—Anthony Stashick
*Attorney, Agent, or Firm*—Melvin L. Barnes, Jr.; Howrey & Simon

[57] ABSTRACT

A shoe having a adjustable cushion sole with fluid bladders disposed therein. Each fluid bladders has an associated pressure sensing device which measures the pressure exerted by the user's foot on the fluid bladder. As the pressure increases over a threshold, a control system partially opens a fluid valve to allow fluid to escape from the fluid bladder. The release of fluid from the fluid bladders reduces the impact of the user's foot with the traveling surface.

20 Claims, 5 Drawing Sheets

FIG. 1
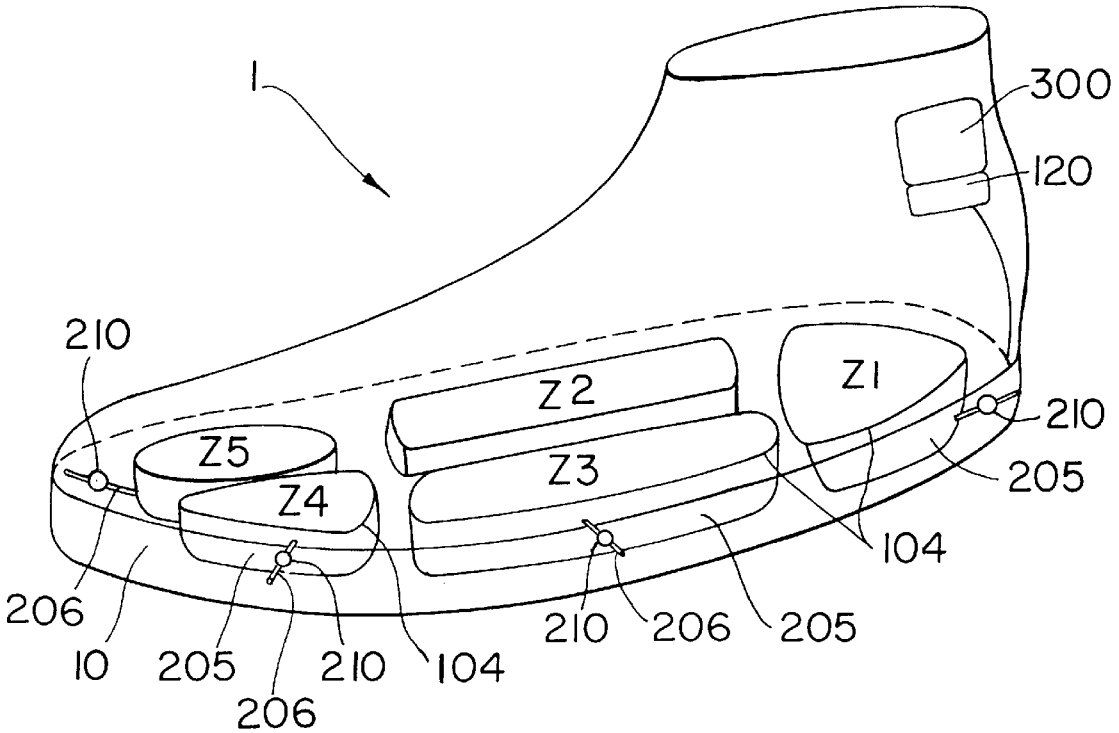
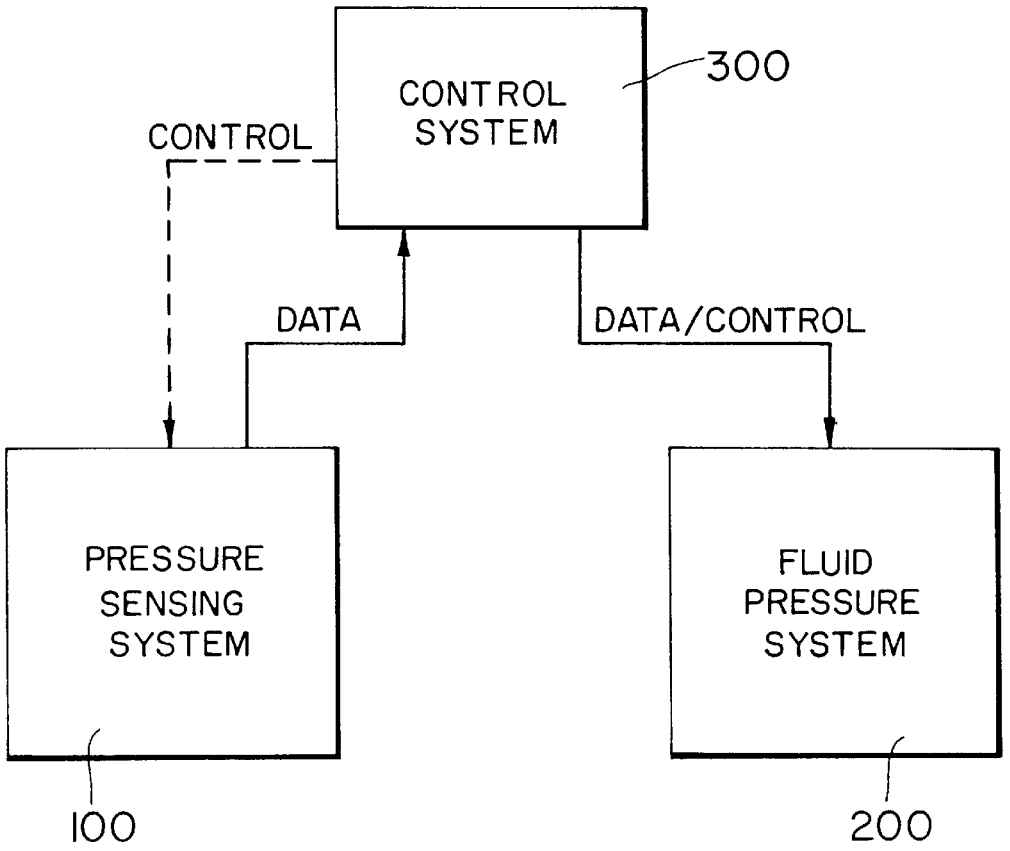
FIG. 2

SHOE SOLE WITH AN ADJUSTABLE SUPPORT PATTERN

This application is a continuation of application Ser. No. 08/599,584, filed Feb. 9, 1996, now abandoned.

BACKGROUND OF THE INVENTION

The invention relates generally to a shoe having an adjustable support pattern and more specifically to a shoe that selectively measures and adjusts the pressure in a number of zones beneath the user's foot as the user's foot impacts the traveling surface.

It is well known that the repeated impact of a person's foot with a traveling surface (such as a floor, roadway, or treadmill) while walking or running can be painful and may eventually lead to fatigue and joint (ankle, knee or hip) wear and tear or even damage. As a result, those skilled in the design and manufacture of shoes have endeavored to reduce the impact of the user's foot with the traveling surface by providing additional cushioning in the sole of the shoe. This is especially true in the design and manufacture of running and other athletic shoes.

A number of popular athletic shoes available incorporate a sole that has an air pocket, which is essentially an air-filled chamber molded into the sole. However, the air pocket is enclosed so that the quantity of air molecules in the pocket is constant so that the resistance to compression of the sole at the location of the air pocket is not variable. The air pocket simply provides a different resistance to compression than other portions of the rubber sole and is strategically placed in the sole to provide a more comfortable shoe.

A number of variations on this approach have been proposed. U.S. Pat. No. 5,199,191 to Moumdjian, discloses a shoe sole with a number of air compartments in fluidic communication with each other. An air valve (such as a conventional air valve on a football or basketball) allows the user to adjust the air pressure in the sole to a desired pressure. Air in one of the compartments can be forced out of the compartment (by the impact of the user's foot with the traveling surface) and into a different compartment upon which less force is exerted (as different portions of the user's foot impact the traveling surface at different times and with different forces). However, the summation of the resistance to compression of the shoe sole is still related to the initial fixed quantity of air disposed in the shoe sole's compartments.

U.S. Pat. No. 5,363,570 to Allen et al. discloses a shoe having a pair of toroidal shaped concentric fluid filled compartments disposed beneath the user's heel and in fluidic communication with each other. Again, fluid in the compartment under greater pressure will flow to the compartment under less pressure. The disclosure more particularly discloses that the cushioning of the sole is determined by the rate of flow between the compartments which in turn can be controlled by the viscosity of the fluid used and the size of the passage between he compartments.

A somewhat different approach is disclosed in U.S. Pat. No. 5,179,792 to Brantingham which provides a shoe that randomly varies the support pattern of the shoe to reduce fatigue. Brantingham discloses a shoe sole having a number of air-filled cells, each with an inlet valve and an outlet valve. The inlet valve valves are one way valves so that when the user's foot is not in contact with the traveling surface and no pressure is applied to the cell, the cell reconforms to its original shape and draws air into the cell. As the user's foot impacts the traveling surface, the inlet valve closes to prevent air from escaping the cell. The outlet valves of the shoe are pseudo-randomly opened to allow the air in only some of the cells to escape. The user's foot is thus tilted in various directions which varies the strain on the muscles of the user's foot and reduces fatigue. However, the release of air from the cells is not controlled to reduce the impact of the user's foot with the traveling surface.

The foregoing review of the prior art indicates that there is a need for a shoe that automatically adjusts the cushioning of the sole in response to the force exerted by the wearer of the shoe. Furthermore, there is a need for a shoe having a sole that provides cushioning that is adjustable to the tastes of the individual wearer and responds to an increase in pressure by providing additional cushioning to the wearer.

SUMMARY OF THE INVENTION

The drawbacks of the prior art are overcome by the present invention, which provides for a shoe that includes a sole portion for reducing the impact of the user's foot with the traveling surface that detects the pressure exerted by the user in each of a number of zones under the user's foot when the foot strikes the traveling surface. A control system compares the pressure in each zone with a predetermined calculated threshold pressure. In the event the threshold pressure of any zone is exceeded, the microcomputer opens a valve controlling the exit of fluid from a fluid bladder disposed in the sole of the shoe in that zone to allow fluid to escape and thereby reduce the impact experienced by the user's foot in that zone of the shoe sole. Consequently, the shoe is self-adjusting as the impact of the user's foot changes by regulating the flow of fluid out of the fluid bladder. When the user's foot leaves the traveling surface and no pressure is applied by the user's foot on the fluid bladders, the fluid bladders reconform themselves and draw fluid back into the fluid bladders. A cushion adjustment control allows the user to adjust or scale the amount of cushioning provided by the shoe.

BRIEF DESCRIPTION OF THE DRAWINGS

FIG. 1 is a perspective view of an embodiment of a shoe employing the principles of the present invention.

FIG. 2 is a schematical representation of the shoe of FIG. 1.

DETAILED DESCRIPTION

Figure 3:
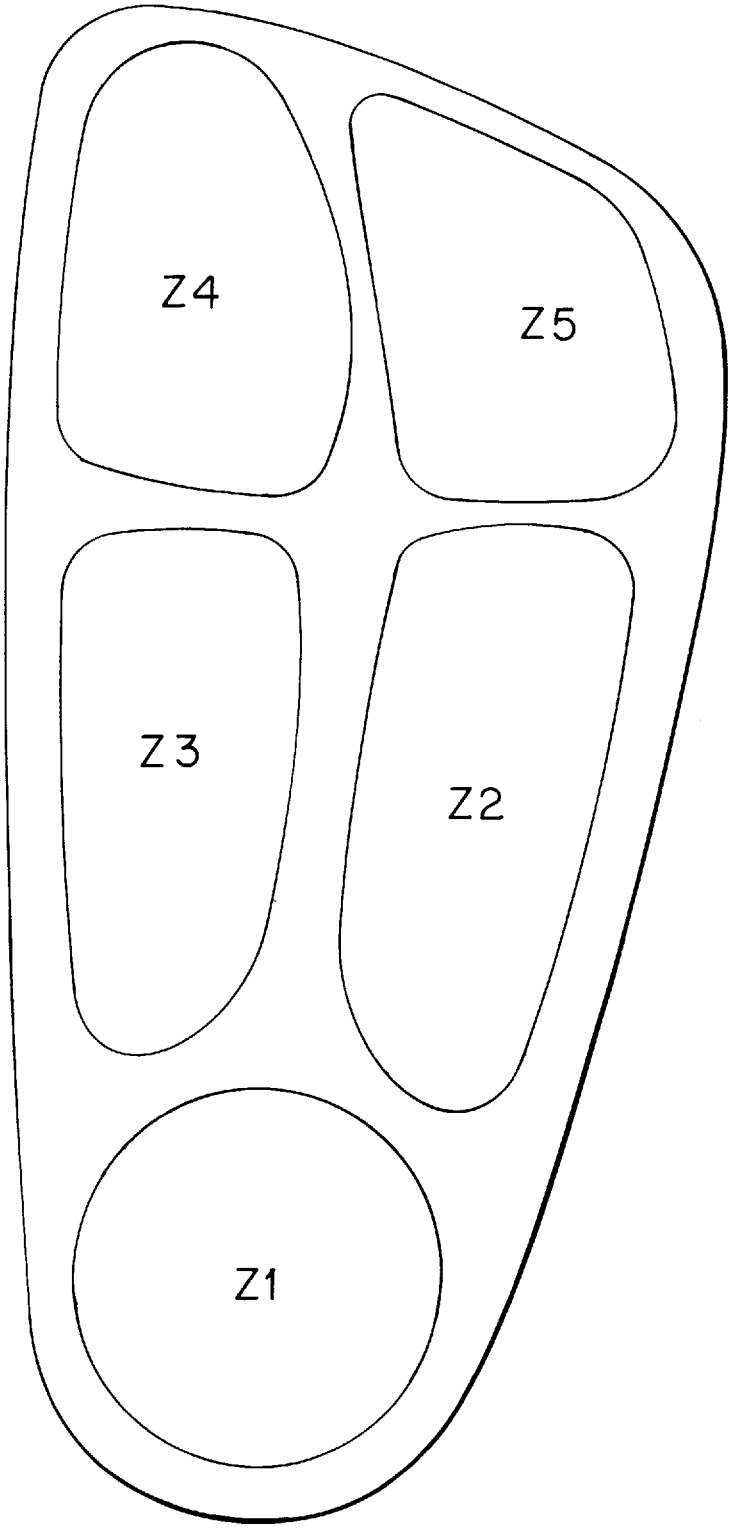
FIG. 3 is a plan view of the shoe sole of FIG. I illustrating the division of the sole into zones.

The shoe 1 of the invention has a sole with fluid bladders disposed therein as shown in FIG. 1. Each fluid bladders has an associated pressure sensing device that measures the pressure exerted by the user's foot on the fluid bladder. As the pressure increases over a threshold, a control system opens (perhaps only partially) a flow regulator to allow fluid to escape from the fluid bladder. Thus, the release of fluid from the fluid bladders reduces the impact of the user's foot with the traveling surface, The principles of the invention are shown schematically in FIG. 2, which illustrates a pressure sensing system 100, a fluid pressure system 200, and a control system 300. In the embodiment shown in FIG. 1 and FIG. 3, the sole of the shoe is divided into five zones Z1–Z5, which roughly correspond to various weight bearing portions of the user's foot such as the heel, the toe, the shank, the ball, and the instep of the foot. Pressure sensing system 100 measures the relative change in pressure in each of the zones. Fluid pressure system 200 reduces the impact experienced by the user's foot by regulating the escape of a fluid from a fluid bladder in each zone of the sole. Control system 300 receives pressure data from pressure sensing system 100 and controls fluid pressure system 200.

Figure 4A:
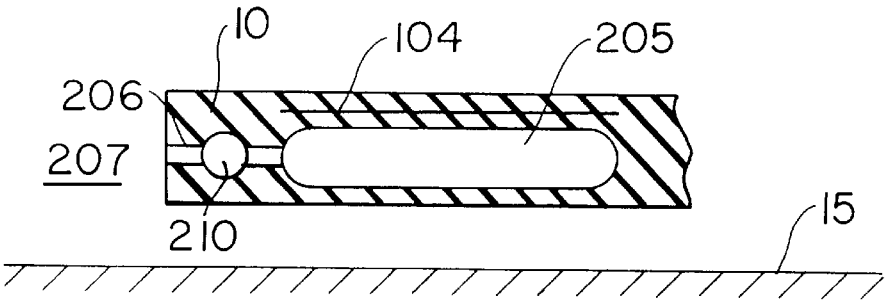
FIG. 4A and FIG. 4B are partial cross-sectional views of the sole of the shoe of FIG. 1.
Figure 4B:
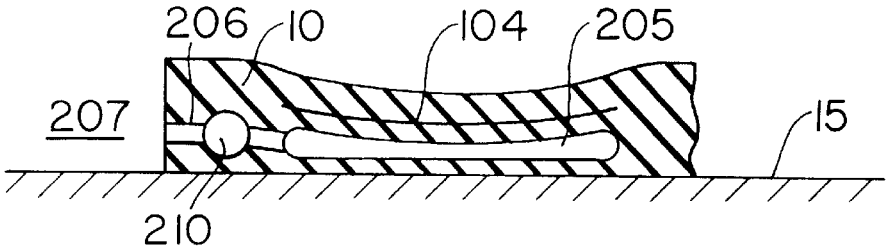
Figure 5:
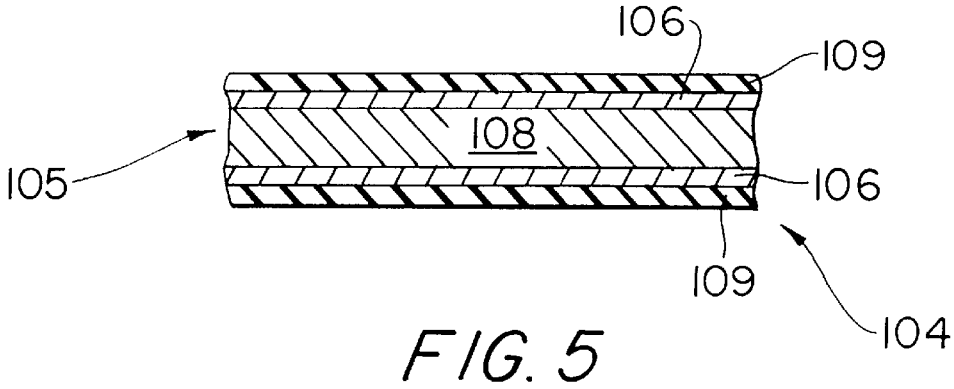
FIG. 5 is a magnified partial cross-sectional view of a pressure sensitive variable capacitor employed in the embodiment of FIG. 1.

Pressure sensing system 100 includes a pressure sensing device 104 disposed in the sole of the shoe at each zone as shown in FIG. 1 and FIG. 4A–B. In this embodiment, pressure sensing device 104 is a pressure sensitive variable capacitor 105, shown in detail in FIG. 5, which maybe formed by a pair of parallel flexible conductive plates 106 disposed on each side of a compressible dielectric 108. The dielectric, which can be made from any suitable material such as rubber or other suitable elastomner. The outside of flexible conductive plates 106 are covered by a flexible sheath 109 (such as rubber) to protect the outside of conductive plates 106.

Since the capacitance of a parallel plate capacitor is inversely proportional to the distance between the plates, applying greater pressure to pressure sensitive variable capacitor 105 compresses dielectric 108 and thereby increases the capacitance of pressure sensitive variable capacitor 105. When the pressure is released, dielectric 108 expands substantially to its original thickness so that pressure sensitive variable capacitor 105 returns substantially to its original capacitance. Consequently, dielectric 108 must have a relatively high compression limit and a high degree of elasticity.

Figure 6:
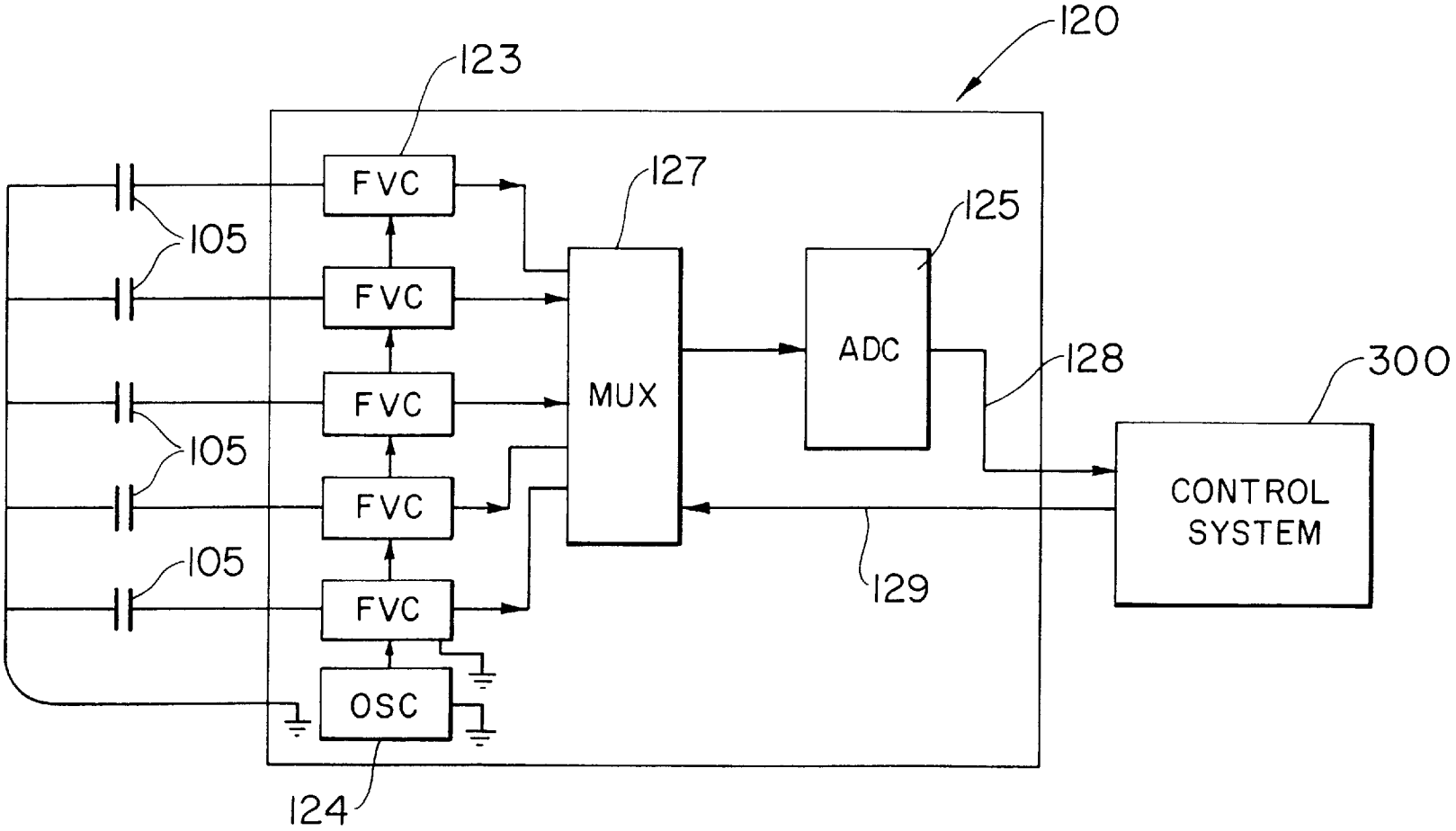
FIG. 6 is a schematical representation of the pressure sensing circuitry employed by the embodiment of FIG. 1.

Pressures sensing system 100 also includes pressure sensing circuitry 120, shown in FIG. 6, which converts the change in pressure detected by variable capacitor 105 into digital data. Each variable capacitor 105 forms part of a conventional frequency-to-voltage converter (FVC) 123 which outputs a voltage proportional to the capacitance of variable capacitor 105. Oscillator 124 is electrically connected to each FVC 123 and provides an adjustable reference oscillator. The voltage produced by each of the five FVCs 123 is provided as an input to multiplexer 127 which cycles through the five channels sequentially connecting the voltage from each FVC 123 to analog-to-digital (A/D) converter 125 which converts the analog voltages into digital data for transmission to control system 300 via data lines 128, connecting each in turn to control system 300 via data lines 128. Control lines 129 allow control system 300 to control the multiplexer 127 to selectively receive data from each pressure sensing device in any desirable order. These components and this circuitry are well known to those skilled and the art and any suitable component or circuitry might be used to perform the same function.

Fluid pressure system 200 selectively reduces the impact of the user's foot in each of the five zones. As shown in FIG. 1 and FIGS. 4A–B, associated with each pressure sensing device 104 in each zone, and embedded in shoe sole 10, is a fluid bladder 205 which forms part of fluid pressure system 200. Each fluid bladder 205 is essentially an empty pocket formed in the sole of the shoe by any known means. Fluid bladder 205 is constructed to deform upon the application of force as the user's foot impacts traveling surface 15 as shown in FIG. 4B, but also to return to its original size and shape as shown in FIG. 4A when the shoe is not in contact with traveling surface 15 such as when the user's foot is in its upward or downward motion during running or walking. A fluid duct 206 is connected at its first end to its respective fluid bladder 205 and is connected at its other end to a fluid reservoir 207. In this embodiment, fluid duct 206 connects fluid bladder 205 with ambient air, which acts as fluid reservoir 207. A flow regulator, which in this embodiment is a fluid valve 210, is disposed in fluid duct 206 to regulate the flow of fluid through fluid duct 206. Fluid valve 210 is adjustable over a range of openings (i.e., variable metering) to control the flow of fluid exiting fluid bladder 205 and may be any suitable conventional valve such as a solenoid valve as in this embodiment.

Control system 300, which includes a programmable microcomputer 301 having conventional RAM and ROM, receives information from pressure sensing system 100 indicative of the relative pressure sensed by each pressure sensing device 104. Control system 300 receives digital data from pressure sensing circuitry 120 proportional to the relative pressure sensed by pressure sensing devices 104. Control system 300 is also in communication with fluid valves 210 to vary the opening of fluid valves 210 and thus control the flow air. As the fluid valves of this embodiment are solenoids (and thus electrically controlled), control system 300 of is in electrical communication with fluid valves 210.

Figure 7:
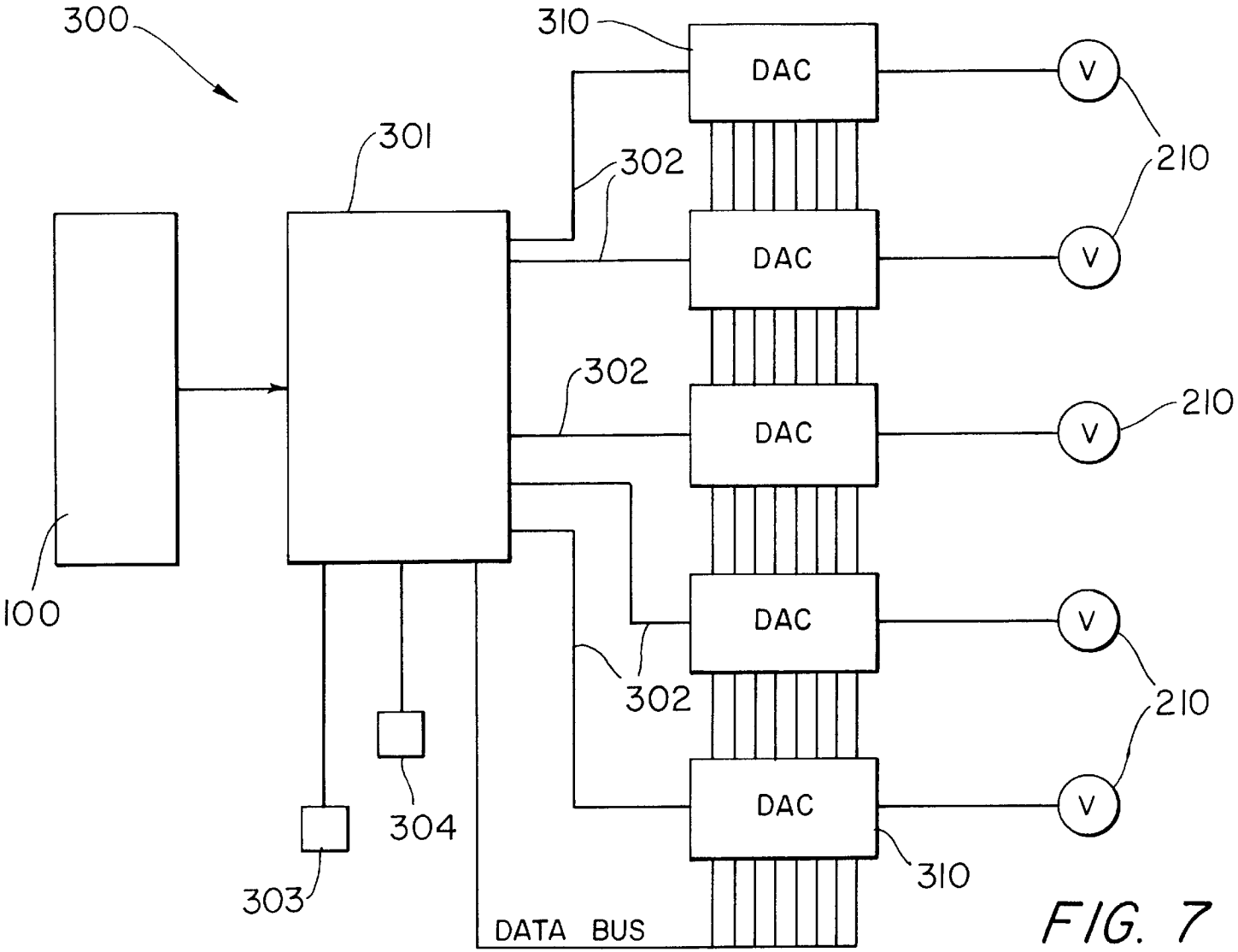
FIG. 7 is a schematical representation of the control system employed by the embodiment of FIG. 1.

As shown in FIG. 7, programmable microcomputer 301 of control system 300 selects (via one of five control lines 302) one of the five digital-to-analog (D/A) converters 310 to receive data from microcomputer 301 to control fluid valves 210. The selected D/A converter 310 receives the data and produces an analog voltage proportional to the digital data received. The output of each D/A converter 310 remains constant until changed by microcomputer 301 (which can be accomplished using conventional data latches not shown). The output of each D/A converter 310 is supplied to each of the respective fluid valves 210 to selectively control the size of the opening of fluid valves 210.

Control system 300 also includes a cushion adjustment control 303 which allows the user to control the level of cushioning response from the shoe. A knob on the shoe is adjusted by the user to provide adjustments in cushioning ranging from no additional cushioning (fluid valves 210 never open) to a maximum cushioning. This is accomplished by scaling the data to be transmitted to the D/A converters (which controls the opening of fluid valves 210) by the amount of desired cushioning as received by control system 300 from cushion adjustment control 303. However, any suitable conventional means of adjusting the cushioning could be used.

An illuminator 304, such as a conventional light emitting diode (LED), is also mounted to the circuit board that houses the electronics of control system 300 to provide the user with an indication of the operation of the apparatus.

Operation

The operation of the invention is most applicable to applications in which the user is either walking or running for an extended period of time during which weight is distributed among the zones of the foot in a cyclical pattern. The system begins by performing an initialization process which is used to set up pressure thresholds for each zone.

During initialization, fluid valves 210 are fully closed while fluid bladders are in their uncompressed state (e.g., before the user puts on the shoes). In this configuration, no air can escape fluid bladders 205 regardless of the amount of pressure applied to fluid bladders 205 by the user's foot. As the user begins to walk or run with the shoes on, control system 300 receives and stores measurements of the change in pressure of each zone from pressure sensing system 100. During this period, fluid valves 210 are kept closed.

Next, control system 300 computes a threshold pressure for each zone based on the measured pressures for a given number of strides. In this embodiment, the system counts ten strides (by counting the number of pressure changes), but another system might simply store data for a given period of time (e.g. twenty seconds). The number of strides are preprogrammed into microcomputer 301, but might be inputted by the user in other embodiments. Control system 300 then examines the stored pressure data and calculates a threshold pressure for each zone. The calculated threshold pressure, in this embodiment, will be less than the average peak pressured measured and is in part determined by the ability of the associated fluid bladder to reduce the force of the impact as explained in more detail below.

After initialization, control system 300 will continue to monitor data from pressure sensing system 100 and compare the pressure data from each zone with the pressure threshold of that zone. When control system 300 detects a measured pressure that is greater than the pressure threshold for that zone, control system 300 opens the fluid valve 210 (in a manner as discussed above) associated with that pressure zone to allow fluid to escape from fluid bladder 205 into fluid reservoir 207 at a controlled rate. In this embodiment, air escapes from fluid bladder 205 through fluid duct 206 (and fluid valve 210 disposed therein) into ambient air. The release of fluid from fluid bladder 205 allows fluid bladder 205 to deform (as shown in FIG. 4B) and thereby lessens the "push back" of the bladder. The user experiences a "softening" or enhanced cushioning of the sole of the shoe in that zone, which reduces the impact on the user's foot in that zone.

The size of the opening at fluid valve 210 should allow fluid to escape fluid bladder 205 in a controlled manner. The fluid should not escape from fluid bladder 205 so quickly that fluid bladder 205 becomes fully deflated (and can therefore supply no additional cushioning) before the peak of the pressure exerted by the user. However, the fluid must be allowed to escape from fluid bladder 205 at a high enough rate to provide the desired cushioning. Factors which will bear on the size of the opening of the flow regulator include the viscosity of the fluid, the size of the fluid bladder, the pressure exerted by fluid in the fluid reservoir, the peak pressure exerted and the length of time such pressure is length.

As the user's foot leaves the traveling surface, air is forced back into fluid bladder 205 by a reduction in the internal air pressure of fluid bladder 205 (i.e., a vacuum is created) as fluid bladder 205 returns to its noncompressed size and shape. After control system 300 receives pressure data from pressure sensing system 100 indicating that no pressure (or minimal pressure) is being applied to the zones over a predetermined length of time (long enough to indicate that the shoe is not in contact with the traveling surface and that fluid bladders 205 have returned to their noncompressed size and shape), control system 300 again closes all fluid valves 210 in preparation for the next impact of the user's foot with the traveling surface.

Pressure sensing circuitry 120 and control system 300 are mounted to the shoe as shown in FIG. 1 and are powered by a common, conventional battery supply. As pressure sensing device 104 and fluid system 200 are generally located in the sole of the shoe, the described electrical connections are embedded in the upper and the sole of the shoe.

Other Embodiments

Although the previously described embodiment has been described as reducing the impact at the peak of the force, the invention would work just as well to reduce the impact in a variety of manners. For example, fluid valves 210 could be gradually opened wider from the beginning of the impact through the peak. Depending on the parameters of fluid valves 210, fluid bladder 205, and the cushioning desired, it may be acceptable to leave fluid valves 210 in a partially opened state permanently (a restriction) or it may be necessary to open fluid valves fully after impact to allow fluid to reenter fluid bladders 205. Furthermore, each fluid valve 210 could be replaced with a variable restriction.

In other embodiments, fluid valves 210 could be mechanically controlled or be manually adjustable pressure sensitive bleed valves. As the pressure reached an adjusted threshold, the bleed valve would open until the pressure was below the threshold. Fluid could freely flow in through the bleed valve or another embodiment might also include a separate fluid duct, with a one way valve disposed therein, to allow fluid to enter the fluid bladders. In addition, other embodiments might use different pressure sensing devices such as pressure sensitive variable resistors.

In the described embodiment, fluid bladders 205 share one fluid reservoir which is ambient air. However, other embodiments that would work just as well would use water as the fluid with the fluid reservoir located on the side of the shoe or each bladder 205 could have its own separate reservoir.

What is claimed is:

1. A shoe to be worn by a user over a plurality of strides, each stride including an impact by the shoe with the traveling surface, the shoe having an adjustable cushioning sole, comprising:

a fluid bladder disposed in the sole having fluid therein;

a duct in communication with said fluid bladder and providing a pathway for fluid to exit the sole of the shoe;

a flow regulator regulating the flow of said fluid through said duct to adjust the pressure in said fluid bladder;

a sensor for sensing the pressure in said fluid bladder; and a control system in communication with said sensor and said flow regulator, said control system being capable of automatically adjusting the pressure in said bladder based on the sensing of a predetermined pressure in said bladder resulting from impact of the shoe with the traveling surface.

2. The shoe of claim 1, further comprising a fluid reservoir in communication with said duct and disposed outside the sole of the shoe for receiving said fluid.

3. The shoe of claim 2, further comprising a cushioning adjustment control for adjusting the level of cushioning provided by the shoe.

4. The shoe of claim 1, wherein:

said control system is a microcomputer in electrical communication with said flow regulator and said sensor and wherein said microcomputer receives and stores pressure data from said sensor and computes said predetermined pressure.

5. A shoe to be worn by a user over a plurality of strides, each stride including an impact by the shoe with the traveling surface, the shoe having an adjustable cushioning sole, comprising:

a fluid bladder disposed in the sole having air contained therein;

a duct in communication with said fluid bladder and ambient air;

means for automatically controlling the flow of air from said fluid bladder to ambient air in response to pressure exerted on said fluid bladder by the foot of the user during the impact of the shoe with the traveling surface; and means for supplying air to said fluid bladder from ambient air between impacts of the shoe with the traveling surface.

6. The shoe of claim 5, wherein said means for controlling the flow of air including includes:

a flow regulator disposed in said duct;

a pressure sensor for sensing the pressure in said fluid bladder; and a control system receiving electrical data signals from said pressure sensing device and providing electrical control signals to adjust the opening of said flow regulator and thereby control the flow of air through said duct.

7. The shoe of claim 6, further comprising:

a plurality of fluid bladders, a flow regulator and pressure sensor associated with each of said fluid bladders; and wherein said control system is a programmable microcomputer in electrical communication with said flow regulators and said sensors and said microcomputer receives and stores pressure data from said sensors.

8. The shoe of claim 7, further comprising a cushioning adjustment control providing an input to said microcomputer for adjusting the level of cushioning provided by the shoe.

9. The shoe of claim 7, wherein said microcomputer is programmed to determine a threshold pressure for each fluid bladder and to adjust said flow regulator to allow air to exit said associated fluid bladder when said sensor detects a pressure greater than said threshold pressure.

10. The shoe of claim 6, wherein said control system includes a programmable microcomputer for calculating a threshold pressure.

11. The shoe of claim 5, wherein said means for automatically controlling the flow of air includes a pressure sensitive fluid regulator.

12. The shoe of claim 6, wherein said flow regulator comprises an adjustable restrictor.

13. The shoe of claim 6, wherein said flow regulator includes a solenoid fluid valve.

14. A method for adjusting the cushioning of a sole of a shoe worn by a user over a plurality of strides, each stride including an impact of the shoe with the traveling surface, the shoe having a fluid bladder disposed in the sole and containing fluid, and a flow regulator controlling the flow of fluid to and from the fluid bladder, said method comprising the steps of:

a. determining a pressure threshold;

b. automatically adjusting the opening of the flow regulator to a first position;

c. monitoring the pressure in the fluid bladder exerted by the foot of the user wearing the shoe as the shoe impacts the traveling surface during a stride;

d. automatically adjusting the opening of the flow regulator to a second position, said second position allowing fluid to escape from the fluid bladder during impact of the shoe with the traveling surface to prevent said monitored pressure from exceeding said pressure threshold;

e. automatically adjusting the opening of the flow regulator to a third position to allow fluid to enter the fluid bladder when the shoe is not impacting the traveling surface; and f. repeating steps b through e over the plurality of strides.

15. The method of claim 14 wherein the step of determining a pressure threshold includes monitoring the peak pressure exerted on a fluid bladder during each stride over the plurality of strides.

16. The method of claim 14 wherein said first position, said second position, and said third position of said flow regulator are different positions.

17. The shoe of claim 1, wherein said control system is capable of adjusting said regulator to allow fluid to enter said fluid bladder between impacts of the shoe with the traveling surface.

18. The shoe of claim 6, wherein said means for supplying air is the reformation of said fluid bladder to a substantially noncompressed size.

19. The shoe of claim 9, wherein said microcomputer is programmed to adjust said flow regulator to allow air to enter said fluid bladders between impacts of the shoe with the traveling surface.

20. The shoe of claim 4, wherein said microcomputer is programmed to adjust said flow regulator to allow fluid to exit said fluid bladder when said sensor detects a pressure greater than said predetermined pressure.

* * * * *